United States Patent [19]

Okada

[11] Patent Number: 4,513,968

[45] Date of Patent: Apr. 30, 1985

[54] DEVICE FOR HOLDING DISPLAY PLATE FOR GAME MACHINE

[75] Inventor: Tomoo Okada, Tochigi, Japan

[73] Assignee: Kabushiki Kaisha Universal, Tochigi, Japan

[21] Appl. No.: 533,957

[22] Filed: Sep. 20, 1983

[30] Foreign Application Priority Data

Sep. 27, 1982 [JP] Japan ..... 57-144842[U]

[51] Int. Cl.[3] ..... A63F 5/04

[52] U.S. Cl. ..... 273/143 R; 40/575; 40/611; 40/156; 52/125.2; 52/764; 52/766; 52/773; 52/775

[58] Field of Search ..... 273/143; 52/125.2, 126.3, 52/764, 766, 770, 773, 775, 780, 783; 40/156, 40/157, 611, 576, 575

[56] References Cited

U.S. PATENT DOCUMENTS

| | | | |
|---|---|---|---|
| 1,079,179 | 11/1913 | Kinney | 40/611 |
| 1,301,586 | 4/1919 | Miller | 40/576 |
| 4,197,688 | 4/1980 | Mauer | 52/766 X |
| 4,299,043 | 11/1981 | Lathrop et al. | 40/611 X |

*Primary Examiner*—Paul E. Shapiro

*Attorney, Agent, or Firm*—Young & Thompson

[57] ABSTRACT

A device for removably holding a display plate with a pay-out table or like thereon at the front of a game machine body is disclosed. A transversally disposed lower plate retainer has a longitudinal groove, in which the lower end of the display plate is inserted, and notches extending from the front surface of the lower plate retainer to the groove. Hands can be inserted into the notches to grasp the lower edge of the display plate. A top bent portion of a cover plate is inserted in the groove of the lower plate retainer adjacent to the lower edge of the display plate. The cover plate covers the lower plate retainer and has a portion held urged by part of a front door.

6 Claims, 6 Drawing Figures

DEVICE FOR HOLDING DISPLAY PLATE FOR GAME MACHINE

BACKGROUND OF THE INVENTION

This invention relates to a device for holding removably holding a display plate on the front of a game machine such as a slot game machine.

In the slot game machine, a display plate having a pay-out list containing prize-winning symbol mark combinations and cross-ponding numbers of coins to be paid out is removably provided on the front of the game machine. FIG. 1 schematically shows a prior art slot game machine. The display plate 2 with a pay-out table is removably mounted on an upper portion of the front of a wooden game machine body 1. A front door 9 having a coin slot 4 and a symbol mark window 8, through which symbol marks provided on the outer periphery of three reels 5 , 6 and 7, is removably mounted on the game machine body below the display plate 2. The display plate 2 is made of a transparent glass plate, and the pay-out table is drawn by paint on its front surface. It is illuminated by a lamp disposed behind it. It is removably mounted on the game machine plate for the replacement of the lamp.

FIG. 2 shows a prior art device for holding a display plate. A wooden lower plate retainer 12 has a groove 12*a* formed on the top and extending in the longitudinal direction. The lower edge 2*a* of the display plate 2 is received in the groove 12*a*. The lower plate retainer 1 is secured to the a channel-like protective frame 13 (see FIGS. 3A and 3B) is fitted on and secured to the upper edge 2*a* of the display plate 2. A cover plate 14 which is made from a metal plate having some elasticity, is secured to the lower edge 2*a* of the display plate 2. The cover plate 14 has a channel-like portion 14*a*, in which the lower edge 2*a* of the display plate 2 is fitted and secured thereto, a front portion 14*b* covering the front of the lower plate retainer 12 and a channel-like portion 14*c*, in which the upper edge 9*a* of the front door 9 is received. The cover plate 14 is fitted, with the lower edge 2*a* of the display plate 2 fitted in its channel-like portion 14*a*, in the groove 12*a* of the lower plate retainer 12, and its channel-like portion 14*c* is clamped between the game machine body 1 and front door 9 by closing the front door 9. With the front door 9 in the closed state as illustrated, the display plate 2 is held in position and will not be detached.

The display plate 2 is removed in a manner as shown in FIGS. 3A and 3B. It is held retainer by upper plate retainer 16 and lower plate retainer 12 as shown in FIG. 3A. Also, the cover plate 14 is held clamped between the game machine body 1 and front door 9 while its channel-like portion 14*a* is set in the groove of the lower plate retainer 12 by the lower edge 2*a* of the display plate 2. When the front door 9 is opened, the cover plate 14 is released from the clamp between the body 1 and front door 9. The display plate 2 now can be removed from the lower plate retainer 12 by raising the cover plate 14 with it and then pulling the cover plate toward the front. Reference numeral 17 designates a guide member serving to guide the side edges of the display plate 2 when mounting the same.

In the structure described above, the cover plate 14 must be fabricated to precisely meet the specified shape and dimensions, and also it must be reliably attached to the lower edge 2*a* of the display plate 2. Much cumbersomeness, therefore, is involved in the manufacture.

Further, when the display plate 2 is removed and reinstalled, it is held rather instably because the removal or reinstallation is done by holding the cover plate 14. Futhermore, the display plate 2 is likely to produce a moment tending to broaden the channel-like portion 14*a*, which leads to the formation of looseness or play. When looseness is produced, the display plate 2 could be detached from the cover plate 14 to fall and be broken while it is being removed or mounted.

SUMMARY OF THE INVENTION

The primary object of the invention is to provide a device for holding a display plate, which can be readily manufactured.

Another object of the invention is provide a device for holding a display plate, which permits ready removal and reinstallation of the display plate.

A further object of the invention is to provide a device for holding a display plate, which can eliminate the possibility of accidental detachment of the display plate to fall and broken during the removal or reinstallation thereof.

According to the invention, the above and other objects, features and advantages are attained by forming a lower plate retainer with a notch to permit removal and reinstallation of the display plate by holding itself as well as permitting the display plate to be held in position and free from ready detachement when a front door is closed. Further, a cover plate is fitted in a groove of a lower plate retainer and adjacent to the front of the display plate to cover the lower plate retainer and enhance the aesthetical effect.

With the display plate holding device according to the invention, the display plate can be removed and reinstalled in a stably supported state because it is removed and reinstalled by holding it with the hands. Thus, it is possible to eliminate the accidental detachement of the display plate to fall and be broken as in the prior art. In addition, the precision of manufacture of the components can be alleviated.

DETAILED DESCRIPTION OF THE INVENTION

Figure 1:
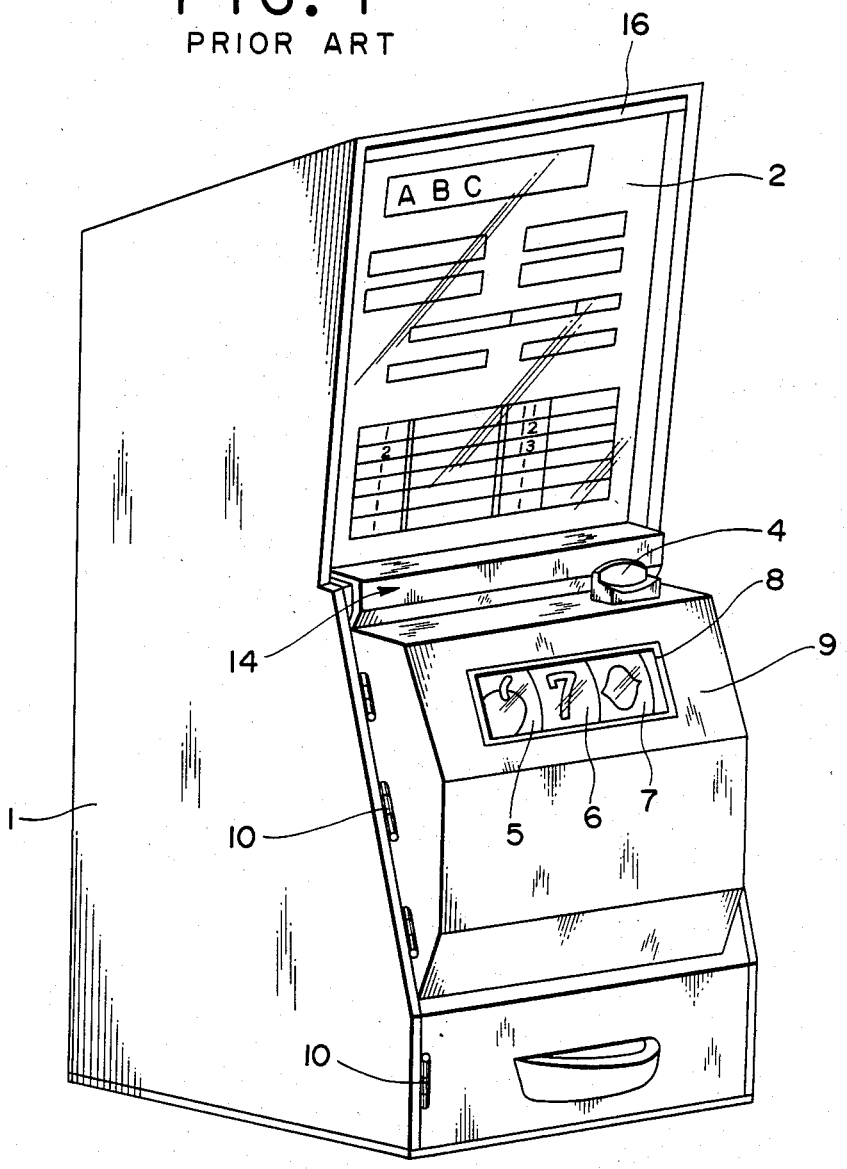
FIG. 1 PRIOR ART
FIG. 1 is a perspective view showing a prior art slot machine.
Figure 2:
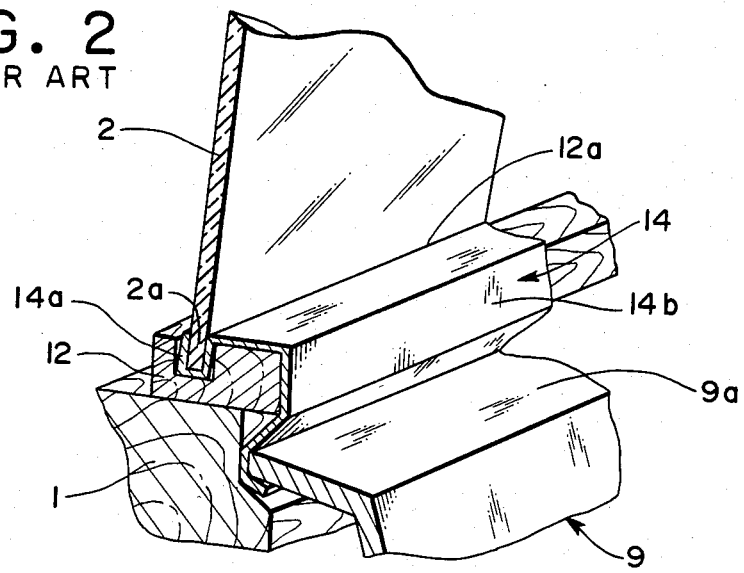
FIG. 2 PRIOR ART
FIG. 2 is a fragmentary perspective view showing a prior art device for holding a display plate.
Figure 4:
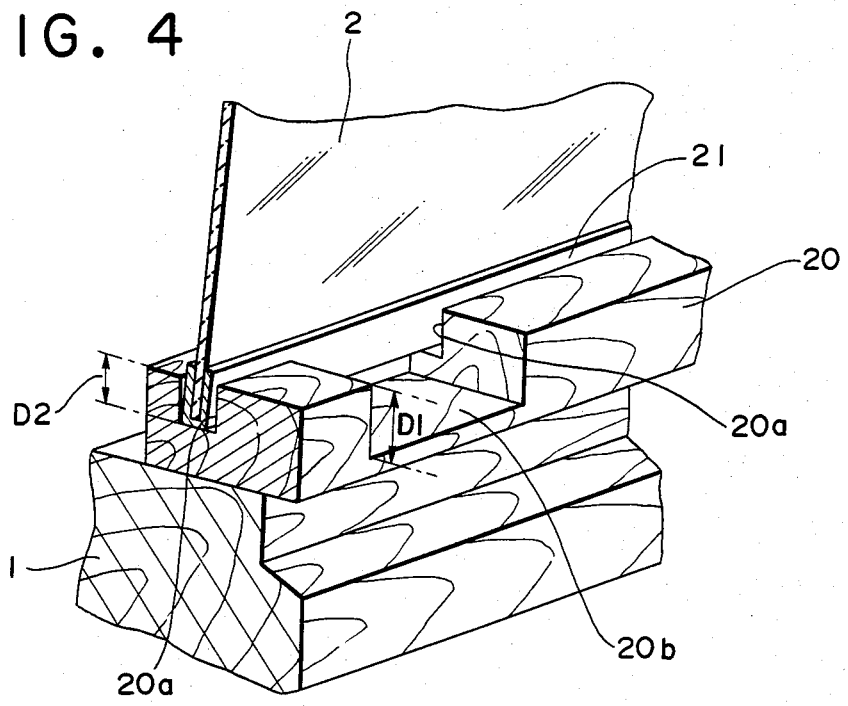
FIG. 4 is a fragmentary perspective view showing an example of the lower plate retainer according to the invention.

FIG. 4 shows a lower plate retainer in a device for holding a display plate according to the invention. In the Figure, corresponding parts to those in FIG. 2 are designated by like reference numerals. A transversally elongated wooden lower plate retainer 20 is secured to part of a wooden game machine body 1. It has a logitudinally extending top groove 20*a* and a notch 20*b* extending from its front surface to the groove 20*b*. The notch 20*b* has a depth $D_1$ greater than the depth $D_2$ of the groove so that hands can be inserted into the space under the lower edge of the display plate 2 when removing and reinstalling the display plate 2. A channel-shaped protective metal frame 21 is securedly fitted on the lower edge 2*a* of the display plate 2.

Figure 5:
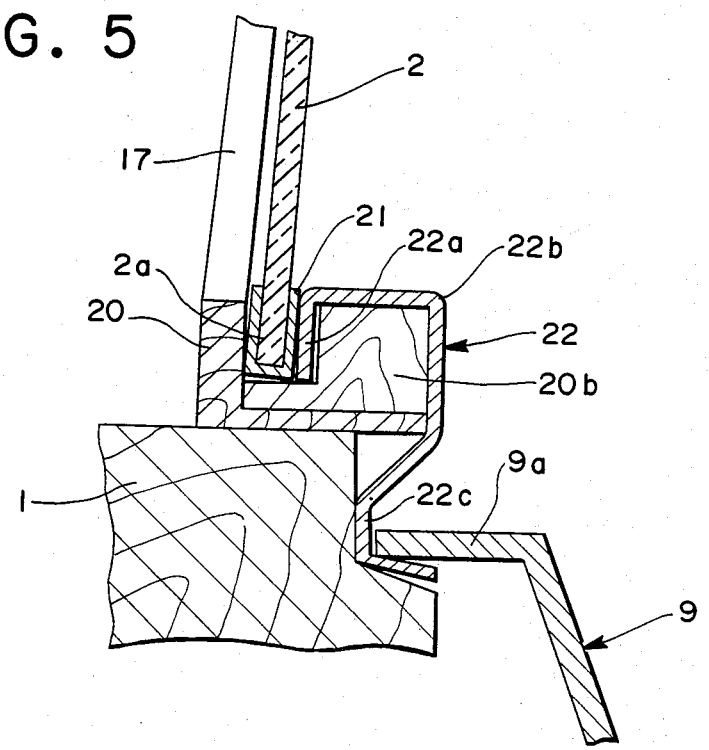
FIG. 5 is a fragmentary sectional view showing a device for holding a display plate according to the invention with cover plate mounted and front door closed.

Reference numeral 22 in FIG. 5 designated a cover plate 22 made from a metal sheet having some elasticity. It has a bent portion 22*a*, which is inserted in the groove 20*a* in the lower plate retainer 20, a portion 22*b* which covers the top and front of the lower plate retainer 20 and a channel-like portion 22, in which the top 9*a* of the front door 9 inserted.

When the front door 9 is closed, the cover plate 22 is clamped between the game machine body 1 and cover plate 9 and serves as a stopper to prevent detachment of the display plate 2 as well as covering the lower plate retainer 20.

Figure 3:
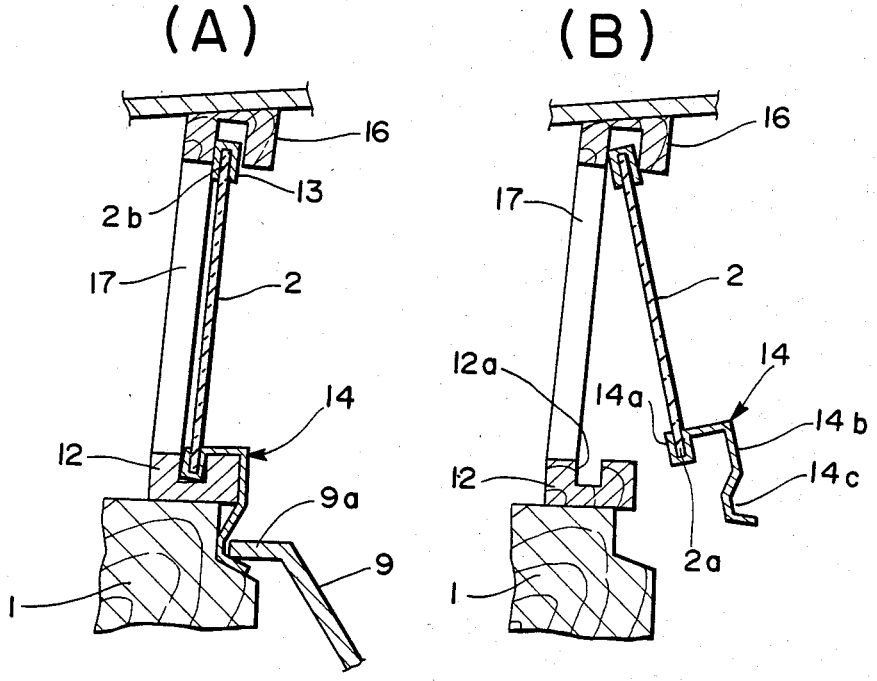
FIG. 3 PRIOR ART
FIGS. 3A and 3B are fragmentary sectional views for explaining the operation of removing and reinstalling a display plate in the prior art device shown in FIG. 2.

To remove the display plate 2, first the front door 9 is opened to release the cover plate 22 form the clamped state. Then the cover plate 22 can be raised in FIG. 5. By so doing, a sufficient space is formed in the notch 20*b* of the lower plate retainer 20 to insert the hands. Thereafter, the display plate 2 is taken away from groove 20*a* of the lower plate retainer 20 by grasping its lower edge 2*a* together with the protective metal frame 21 and pushing it up into a groove of an upper plate retainer 16 (see FIG. 3A). Then it can be removed by pulling it toward the front while detaching it from the groove of the upper plate retainer 16.

What is claimed is:

1. In a game machine, in which a display plate with display characters or the like thereon is fitted in a groove of a plate retainer secured to the front of a machine body and a front door is hinged to the machine body at a position beneath the display plate, a device for removably holding the display plate comprising:

a lower plate retainer secured to said machine body and having a groove for receiving the lower edge of said display plate and a notch perpendicular to said groove and having a greater depth than the depth of said groove; and a cover plate disposed to cover the front of said lower plate retainer, said cover plate having a top bent lower portion inserted in said groove of said lower plate retainer adjacent to the lower edge of said display plate and also having a lower portion held urged by a top portion of said front door.

2. The device according to claim 1, wherein said display plate is made of glass.

3. The device according to claim 2, wherein a protective frame having a channel-shaped sectional profile is fitted on the edges of said display plate.

4. The device according to claim 3, wherein said cover plate is made from a metal sheet having some elasticity.

5. The device according to claim 4, wherein said cover plate has a channel-like portion to receive the top edge of said front door.

6. The device according to claim 5, wherein said lower plate retainer has two notches so that both hands can be inserted thereinto.

* * * * *